United States Patent [19]

Holtorf

[11] 4,182,241

[45] Jan. 8, 1980

[54] HAND OPERATED STAMP

[75] Inventor: Erhard Holtorf, Rodgau, Fed. Rep. of Germany

[73] Assignee: Ferrero OHG, Frankfurt am Main, Fed. Rep. of Germany

[21] Appl. No.: 874,010

[22] Filed: Jan. 31, 1978

[30] Foreign Application Priority Data

Feb. 16, 1977 [DE] Fed. Rep. of Germany ... 7704672[U]

[51] Int. Cl.[2] ..... B41K 1/56

[52] U.S. Cl. ..... 101/405; 101/368; 101/379

[58] Field of Search ..... 15/210, 5, 103, 109, 15/348, 125, 368, 426, 405, 406, 379, 380; 46/76 R; 425/308, 588

[56] References Cited

U.S. PATENT DOCUMENTS

| | | | |
|---|---|---|---|
| 1,272,028 | 7/1918 | Evans et al. | 101/125 |
| 1,420,376 | 6/1922 | Hellesoe | 101/405 |
| 2,199,067 | 4/1940 | Buschow | 101/125 |
| 2,339,443 | 1/1944 | Wilson | 425/588 |
| 2,830,323 | 4/1958 | Kiebs, Jr. et al. | 425/588 |
| 2,835,196 | 5/1958 | Herbert et al. | 101/405 |
| 2,846,725 | 8/1958 | Tryfus | 425/588 |
| 3,338,162 | 8/1967 | Davis | 101/379 |
| 3,410,209 | 11/1968 | Bostrom | 101/368 |
| 3,843,437 | 10/1974 | Robinson | 101/27 |
| 4,030,414 | 6/1977 | McGuire | 101/379 |

FOREIGN PATENT DOCUMENTS

| | | | |
|---|---|---|---|
| 2332501 | 8/1974 | Fed. Rep. of Germany | 101/368 |
| 2421765 | 11/1974 | Fed. Rep. of Germany | 101/368 |

*Primary Examiner*—William Pieprz

*Attorney, Agent, or Firm*—Sughrue, Rothwell, Mion, Zinn and Macpeak

[57] ABSTRACT

A hand operated stamp has only two parts, a resilient printing section and a firmer handling portion, both molded of plastic and being relatively flat. The printing section is tray-shaped to hold the handling portion, and the stamp can be molded together with other stamps connected by removable connecting pieces.

13 Claims, 2 Drawing Figures

FIG. 1
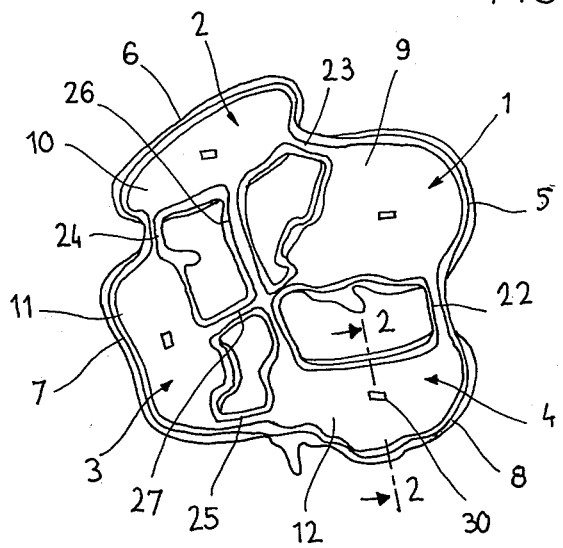
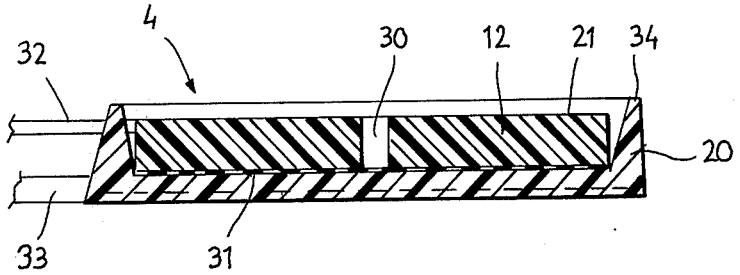
FIG. 2

HAND OPERATED STAMP

BACKGROUND OF THE INVENTION

1. Field of the Invention

This invention relates to improvements in hand operated stamps, particularly such a stamp having a resilient printing section and a harder and firmer handling portion.

2. Brief Description of the Prior Art

There are known in the prior art hand operated stamps of various designs and construction. A common hand operated stamp has a wooden handle for handling and a rubber printing section into which letters, groups of letters, signs or ornaments are molded; the rubber printing section being glued or otherwise attached to the wooden handle. The handle may be in the shape of a ball or a crossbar in order to facilitate ease of operation and application of pressure for printing.

Other known small hand operated stamps have rubber portions carrying letters or the like and a bar shaped handle section which protrudes vertically from the printing base portion.

The prior known hand operated stamps take up considerable space and, while relatively simple, are not extremely economical to produce.

SUMMARY OF THE INVENTION

This invention provide a hand operated stamp which can be produced simply and very economically, and is especially space-saving. This objection is accomplished by having a printing section which is at least partially designed in the shape of a tray or shell to accept a handling portion. The handling portion is in the shape of a thin plate which is almost completely surrounded by the rim of the printing portion. In this manner, a hand operated stamp is created which occupies very little space and can be produced quite fast and simply.

In this invention, it is useful if the printing section as well as the handling portion are made of plastic. The plastic can be chosen from any type of synthetic material offering the desired characteristics. A plastic material which has been softened sufficiently can be used for the printing section, and the same material of a firmer or harder consistency can be used for the handling portion. In which case, less softening agent is added to the handling portion. The handling portion can have a thickness of 1 mm. to 3 mm. and the printing section can have a thickness from 0.5 mm. to 4 mm.

Both the printing section and the handling portion can be produced by means of injection molding procedures, and the handling portion may be glued to the printing section or the printing section may be shrunk onto the handling portion.

For all practical purposes, only the printing surface of the printing section is surface structured, i.e. it is the portion that does the printing. At least two connecting strips can be provided on both the printing section and the handling portion. The connecting strips are molded in the production procedure and can be easily severed for instance, with scissors. On the other hand, the connecting strips can be utilized without severing for the combined use of several connected hand operated stamps.

The rim of the tray-shaped printing section can have notches in the areas of the connecting strips of the handling portion. It is also possible for the connecting strips of the printing section to coincide with those of the handling portion. In one embodiment there are approximately three connecting strips between connected hand operated stamps so that a series of plate-like units of stamps may be combined.

In the center of the handling portion there may be a small opening for the insertion of a separate strip as a handle and to provide more resiliency.

BRIEF DESCRIPTION OF THE DRAWINGS

FIG. 1 is a top plan view of a hand operated stamp viewed from the handling portion side.

FIG. 2 is a sectional view taken along line 2—2 of FIG. 1 on an enlarged scale.

DESCRIPTION OF THE PREFERRED EMBODIMENT

FIG. 1 shows four operated stamps, 1, 2, 3 and 4, each having a printing section, 5, 6, 7 and 8, respectively. Each printing section is designed as a flat trough or tray. Each tray-shaped printing section has upstanding edges to accept handling portions 9, 10, 11 and 12, respectively. The handling portions are shaped to occupy the space within the rim formed by the edges of the tray-shaped printing portion.

The printing section has a printing surface formed by molding on the side not visible in FIG. 1. That is, the surface shown at the bottom of FIG. 2 is configured to accomplish the printing with raised portions and depressed portions. The raised portions when wetted with ink and pressed against a printing surface accomplish a printing function. The thickness of the printing section is between 1.0 mm. and 2.0 mm., and the handling portions 9, 10, 11 and 12 are inserted into the printing sections, respectively, so that the edges 20 of the tray-like printing sections extend upwardly above the upper surface of the handling portion as shown in FIG. 2.

The handling portion is made up of a plastic material which is less resilient and more firm than the printing section. The handling portion has, for example, a thickness of 2.0 mm.

The four individual hand operated stamps, 1, 2, 3 and 4, may be produced together in one unit. They are connected in the molding operation by connecting strips 22, 23, 24 and 25 formed in the production procedure. These connecting strips connect the four hand operated stamps in the approximate shape of a circle, while additional connecting strips 26 and 27 cross at the center, thus representing the shortest connection between the individual hand operated stamps.

Each handling portion is provided with a small slotted opening 30 to increase the resiliency between the printing section and the handling section. An additional handle element (not shown) may, if desired, be molded into the connected strips so that it may be broken off and inserted vertically into the slotted opening 30.

In the design as shown, the handling portion is attached to the flat inner surface of the printing section by a layer of glue 31.

The edges 20 of the tray-shaped printing section are notched at such places where the connecting strips 22, 23, 24 and 25 between the individual handling portions extend toward one another.

Connecting strips 33 of the printing section coincide with connecting strips 32 of the handling portion to provide the composite connecting strips 22, 23, 24, 25, 26 and 27.

While in the design as shown in the drawing, the edges 20 of the printing section are tapered towards free edges 34, as shown in FIG. 2, it is also possible to shape the printing section in such a manner as to have the inner edge sides run vertical to the bottom surface, thus permitting the printing section to be shrunk onto the handling section without the need of glue.

The hand operated stamp, as in this invention, has a total thickness between 3.0 mm. and 6.0 mm. and is thus useful as a flat hand operated stamp. By reason of space ecomony, the stamp can be inserted, e.g. for advertising purposes, in flat hollow spaces without difficulty. One such example being caps of glass jars such as used for spread for bread or other products. Hence the hand operated stamps of this invention can be used for advertising and promotion by being inserted in jar caps.

What is claimed is:

1. A hand operated stamp of the type including a molded plastic resilient printing section and a separately molded handling portion of a firmer plastic material than that of said printing section with the improvements comprising the printing section being molded in a generally flat tray shape having a printing surface on one side thereof with edges extending generally vertically therefrom in a direction away from the printing surface and around the periphery thereof to receive the handling portion in the bottom of the tray, the handling portion being in the form of a thin plate which is surrounded almost completely by the edges of the tray-shaped section.

2. A hand operated stamp as in claim 1 in which the handling portion and printing section are molded of plastic.

3. A hand operated stamp as in claim 2 wherein the handling portion has a thickness of 1.0 mm. to 3.0 mm.

4. A hand operated stamp as in claim 1 in which the printing section has a thickness of 0.5 mm. to 4.0 mm.

5. A hand operated stamp as in claim 1 in which the printing section and handling portion are injection molded.

6. A hand operated stamp as in claim 1 in which the handling portion is glued to the printing section.

7. A hand operated stamps as in claim 1 wherein the printing section is shrunk onto the handling portion.

8. A hand operated stamp as in claim 1 in which the printing face of the printing section is surface structured.

9. A hand operated stamp as in claim 5 in which there are at least two connecting strips for each printing section and handling section.

10. A hand operated stamp as in claim 9 in which the edge of the printing section is notched in the area of the connecting strips of the handling portion.

11. A hand operated stamp as in claim 9 in which the connecting strips of the printing section coincide with those of the handling portions.

12. A hand operated stamp as in claim 9 in which there are three connecting strips for each printing section and handling portion.

13. A hand operated stamp as in claim 9 in which the handling portion has a small opening in the approximate center area.

* * * * *